US009570831B2

(12) United States Patent
Nakai et al.

(10) Patent No.: US 9,570,831 B2
(45) Date of Patent: Feb. 14, 2017

(54) RETAINING STRUCTURE FOR TERMINAL FITTING

(71) Applicant: YAZAKI CORPORATION, Tokyo (JP)

(72) Inventors: Satoshi Nakai, Shizuoka (JP); Toru Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/922,283

(22) Filed: Oct. 26, 2015

(65) Prior Publication Data

US 2016/0043492 A1 Feb. 11, 2016

Related U.S. Application Data

(63) Continuation of application No. PCT/JP2014/061497, filed on Apr. 23, 2014.

(30) Foreign Application Priority Data

May 7, 2013 (JP) ..... 2013-097785

(51) Int. Cl.
*H01R 13/405* (2006.01)
*H01R 13/422* (2006.01)
(Continued)

(52) U.S. Cl.
CPC ..... *H01R 13/405* (2013.01); *H01R 13/4226* (2013.01); *H01R 13/5205* (2013.01);
(Continued)

(58) Field of Classification Search
CPC ..... H01R 13/4223; H01R 13/5219; H01R 13/523; H01R 13/6275; H01R 24/58; H01R 39/64; H01R 43/16
See application file for complete search history.

(56) References Cited

U.S. PATENT DOCUMENTS 4,448,468 A * 5/1984 Coldren ..... H01R 13/20 439/266
5,746,624 A 5/1998 Ohsumi et al.
(Continued)

FOREIGN PATENT DOCUMENTS

JP 8-306431 A 11/1996
JP 10-40993 A 2/1998
(Continued)

OTHER PUBLICATIONS

International Search Report and Written Opinion of the International Search Report for PCT/JP2014/061497 dated Jun. 3, 2014.
(Continued)

*Primary Examiner* — Truc Nguyen
(74) *Attorney, Agent, or Firm* — Kenealy Vaidya LLP

(57) ABSTRACT

A retaining structure for a terminal fitting includes: a terminal fitting which has a cylindrical electric contact portion at a front end side and an electric wire connecting portion at a rear end side; a housing with which a cylindrical portion is integrally formed; a terminal accommodating chamber which is provided inwards of the cylindrical portion and which accommodates the terminal fitting with a moving gap left; and locking lances which are formed on a cylindrical wall portion of the cylindrical portion so as not to project from an outer circumferential surface thereof and which lock a lance locking portion of the terminal fitting which is inserted into the terminal accommodating chamber so as to retain the terminal fitting in such a way as to enable a radial movement of the terminal fitting while restricting a rearward withdrawal of the terminal fitting.

4 Claims, 5 Drawing Sheets

(51) Int. Cl.

| | |
|---|---|
| *H01R 103/00* | (2006.01) |
| *H01R 13/52* | (2006.01) |
| *H01R 13/56* | (2006.01) |
| *H01R 13/6592* | (2011.01) |

(52) U.S. Cl.

CPC ..... *H01R 13/5219* (2013.01); *H01R 13/562* (2013.01); *H01R 13/6592* (2013.01); *H01R 2103/00* (2013.01)

(56) References Cited

U.S. PATENT DOCUMENTS

| | | | | |
|---|---|---|---|---|
| 2003/0157835 | A1* | 8/2003 | Ishikawa | H01R 13/4223 439/595 |
| 2003/0207607 | A1 | 11/2003 | Matsumoto et al. | |
| 2004/0072465 | A1* | 4/2004 | Murakami | H01R 13/6272 439/374 |
| 2004/0082219 | A1* | 4/2004 | Tabata | H01R 13/4223 439/595 |
| 2008/0070440 | A1* | 3/2008 | Morello | H01R 13/4223 439/595 |
| 2009/0035993 | A1* | 2/2009 | Okayasu | H01R 4/185 439/607.41 |
| 2013/0072061 | A1* | 3/2013 | Morikawa | H01R 4/70 439/587 |
| 2013/0157522 | A1 | 6/2013 | Kobayashi et al. | |
| 2013/0288542 | A1* | 10/2013 | Zheng | H01R 13/4223 439/744 |

FOREIGN PATENT DOCUMENTS

| | | | |
|---|---|---|---|
| JP | 2003-323932 | A | 11/2003 |
| JP | 2009-170301 | A | 7/2009 |
| JP | 2010-49866 | A | 3/2010 |
| JP | 2012-43718 | A | 3/2012 |

OTHER PUBLICATIONS

International Preliminary Report on Patentability and English language Written Opinion of the International Search Report for PCT/JP2014/061497.

Japanese Office Action for the related Japanese Patent Application No. 2013-097785 dated Sep. 27, 2016.

* cited by examiner

RETAINING STRUCTURE FOR TERMINAL FITTING

CROSS REFERENCE TO RELATED APPLICATION

This application is a continuation of PCT application No. PCT/JP2014/061497, which was filed on Apr. 23, 2014 based on Japanese Patent Application (No. 2013-097785) filed on May 7, 2013, the contents of which are incorporated herein by reference. Also, all the references cited herein are incorporated as a whole.

BACKGROUND OF THE INVENTION

1. Technical Field

One or more embodiments of the present invention relate to a retaining structure for a terminal fitting.

2. Description of the Related Art

Electric power is supplied to a drive motor of an electric vehicle or a hybrid vehicle via a connector. In connectors for use for motors, a terminal fitting is rigidly fixed to a connector housing to transmit high voltage electric power. However, in a case of a connector in which a terminal fitting and a connector housing cannot move relative to each other, in attempting to connect the connector to a mating connector, when the terminal fitting is misaligned with a terminal fitting of the mating connector due to a dimensional tolerance of a gap defined between the terminal fittings, a large frictional force may be produced, making it difficult for the connector to be connected to the mating connector.

Therefore, a shielded connector is proposed which facilitates a smooth connection with a mating connector (see below-described PTL 1).

As shown in FIG. 5, this shielded connector 501 includes a connector housing 503, a terminal fitting 505 and an inner housing 507.

The connector housing 503 is made of conductive metal and has a cylindrical shape. The connector housing 503 includes a plurality of terminal accommodating chambers 509. The terminal fitting 505 is accommodated in the inner housing 507. The terminal fitting 505 is made of conductive metal and includes an electric wire connecting portion 511 and an electric contact portion 513 which are integrated with each other. The electric wire connecting portion 511 and the electric contact portion 513 are formed into cylindrical shapes and are coaxially connected to each other and in series. A core wire 517 of a shielded electric wire 515 is inserted into an inside of the electric wire connecting portion 511, which is then crimped for connection with the shielded electric wire 515.

The inner housing 507 is made of an insulating synthetic resin and has a cylindrical shape. The inner housing 507 accommodates the terminal fitting 505 and an end portion of the shielded electric wire 515 which is connected to the terminal fitting 505. A pair of lances (locking lances) 519 are provided on the shielded connector 501, and these lances 519 are formed integrally with the inner housing 507. The lances 519 are locked at a step portion 521 of the connector housing 503 to thereby fix the inner housing 507 to the connector housing 503. The pair of lances 519 are so flexible that they can elastically be deformed so as to move towards each other. Additionally, the shielded connector 501 includes a packing 523 which keeps the boundary between the shielded electric wire 515 and the inner housing 507 watertight.

According to this shielded connector 501, the cylindrical inner housing 507 is allowed to move in a radial direction relative to the connector housing 503 as a result of the lances 519 being elastically deformed. Further, the terminal fitting 505 and the inner housing 507 are allowed to move relative to each other by the gap defined between the terminal fitting 505 and the inner housing 507. In connecting the shielded connector 501 to the mating connector, the terminal fitting 505 and the inner housing 507 move relative to the connector housing 503 so that the terminal fitting 505 is aligned with the terminal fitting of the mating connector. Consequently, the shielded connector 501 can be connected smoothly to the mating connector.

PTL 1 is JP-A-2003-323932.

SUMMARY OF THE INVENTION

In the related-art shielded connector 501 described above, however, in order to enable the smooth connection with the mating connector, the gap is provided between the terminal fitting 505 and the inner housing 507, and the lances 519 capable of correct misalignment are provided between the inner housing 507 and the connector housing 503. This may causes a problem that the overall size of the connector is increased.

In addition, a lance flexible space 525 has to be secured inside each lance 519. Additionally, since the shielded electric wire 515 is inserted into the inner housing 507 which lies further inwards than the lance flexible spaces 525, the packing 523 has to be provided between the shielded electric wire 515 and the inner housing 507. Therefore, a water proofing structure may become complicated.

The invention has been made in view of these situations, and an object of the embodiments of the invention is to provide a retaining structure for a terminal fitting which can be simple in construction and small in size while being able to correct misalignment in connecting terminals.

The object related to the embodiments will be achieved by the following configurations.

(1) A retaining structure for a terminal fitting, the structure including a terminal fitting which has a cylindrical electric contact portion at a front end side and an electric wire connecting portion at a rear end side thereof, a housing with which a cylindrical portion is integrally formed, a terminal accommodating chamber which is provided inwards of the cylindrical portion and which accommodates the terminal fitting with a moving gap left which enables a radial movement of the electric contact portion, and a plurality of locking lances which are formed on a cylindrical wall portion of the cylindrical portion so as not to project from an outer circumferential surface thereof and which lock a lance locking portion of the terminal fitting which is inserted into the terminal accommodating chamber so as to retain the terminal fitting in such a way as to enable a radial movement of the terminal fitting while restricting a rearward withdrawal of the terminal fitting.

According to the retaining structure for a terminal fitting configured in the way described under (1) above, when the terminal fitting is inserted into the terminal accommodating chamber, the plurality of locking lances lock the lance locking portion on the terminal fitting to thereby prevent the rearward withdrawal of the terminal fitting. When a mating connector is connected, in case a rod-shaped electric contact portion of the mating connector is misaligned with respect to the electric contact portion of the terminal fitting, the terminal fitting is moved (aligned) to a position where a center of the electric contact portion of the terminal fitting is aligned with a center of the rod-shaped electric contact portion of the mating connector as a result of an elastic deformation of the plurality of locking lances. Namely, the unaligned state of the electric contact portion of the terminal fitting with respect to the rod-shaped electric contact portion is corrected, thereby enabling an easy connector connection. This movement of the terminal fitting is allowed within the moving gap defined between the terminal fitting and the terminal accommodating chamber.

Additionally, since the locking lances are formed so as not to project from the outer circumferential surface of the cylindrical wall portion even in the event that the moving gap becomes nil (namely, in the event that the terminal fitting comes into contact with an inner wall of the terminal accommodating chamber), there is no such situation that a problem is caused in connection of the cylindrical portion with the mating connector.

In addition, the direct formation of the locking lances on the cylindrical wall portion which defines the terminal accommodating chamber obviates an exclusive space to dispose only the locking lances. Although, in the related-art retaining structure, the water proofing construction has to be secured between the shielded electric wire and the inner housing inwards of (in alignment in a radial direction with) the portion where the locking lances and the terminal accommodating chamber are formed, no such water proofing construction is necessary, and only the simple packing may be provided on an inner circumference of the cylindrical wall portion, which simplifies the water proofing construction.

In the retaining structure for a terminal fitting described above, in the event that the terminal fitting is inserted halfway into the terminal accommodating chamber, thereby producing a non-retained state (that is, a half-fitted state) in which the terminal fitting is not completely locked by the locking lances, the locking lances may project from the outer circumferential surface of the cylindrical wall portion.

(2) In the retaining structure for a terminal fitting according to (1) above, the plurality of locking lances of three or more are provided along a circumferential direction of the cylindrical portion.

According to the retaining structure for a terminal fitting configured in the way described under (2) above, when the terminal fitting is inserted into the terminal accommodating chamber, the three or more locking lances which are provided along the circumferential direction of the cylindrical portion are brought into slidable contact with the electric contact portion, whereby the terminal fitting can easily be positioned at the center of the cylindrical portion. In the case of a cylindrical portion having a limited circumferential length, in securing the strength of the cylindrical portion, as well as the strength of the locking lances, it is preferable that the number of locking lances is three at the least.

(3) In the retaining structure for a terminal fitting according to (1) or (2) above, the lance locking portion which is locked by the locking lances is formed on the electric contact portion by folding back an electric contact portion leading end so as to be laid on to an outer circumferential surface of the electric contact portion.

According to the retaining structure for a terminal fitting configured in the way described under (3) above, laying the folded back leading end of the electric contact portion on the outer circumferential surface thereof makes the portion where the folded back leading end is so laid constitute a large diameter portion which is larger in diameter by a thickness of the electric contact portion than the outer circumferential surface of the electric contact portion, thereby producing a difference in level between the large diameter portion and the outer circumferential surface of the electric contact portion. By configuring a step portion which is produced by the difference in level as the lance locking portion, it is possible to easily form the strong and rigid lance locking portion.

According to the retaining structure for a terminal fitting of the embodiments, misalignment in connecting terminals can be corrected, and a retaining structure can be provided which is simple in construction and small in size.

Thus, the embodiments have been briefly described heretofore. Further, the details of the embodiments will be clarified more by perusing a mode for carrying out the invention (hereinafter, referred to as an "embodiment") which will be described herebelow.

DETAILED DESCRIPTION OF THE EXEMPLARY EMBODIMENTS

Hereinafter, an embodiment according to the invention will be described by reference to the drawings.

Figure 1:
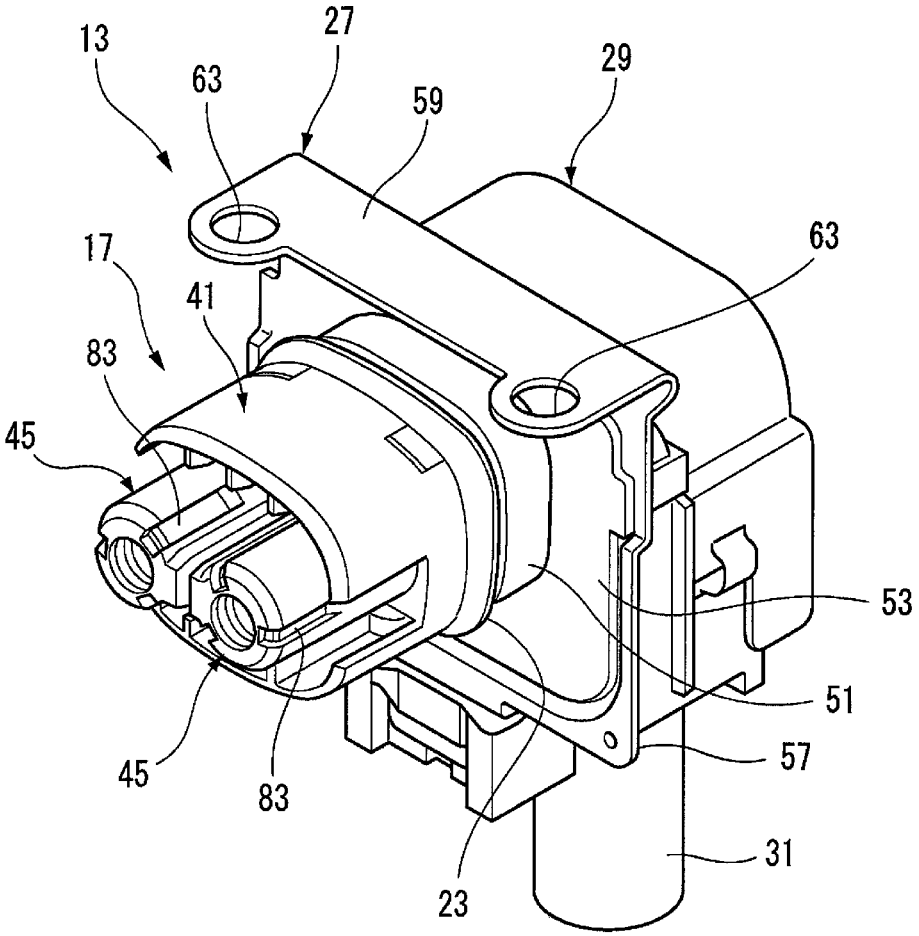
FIG. 1 is a perspective view of a high-voltage female connector including a retaining structure for a terminal fitting according to an embodiment of the invention.
Figure 2:
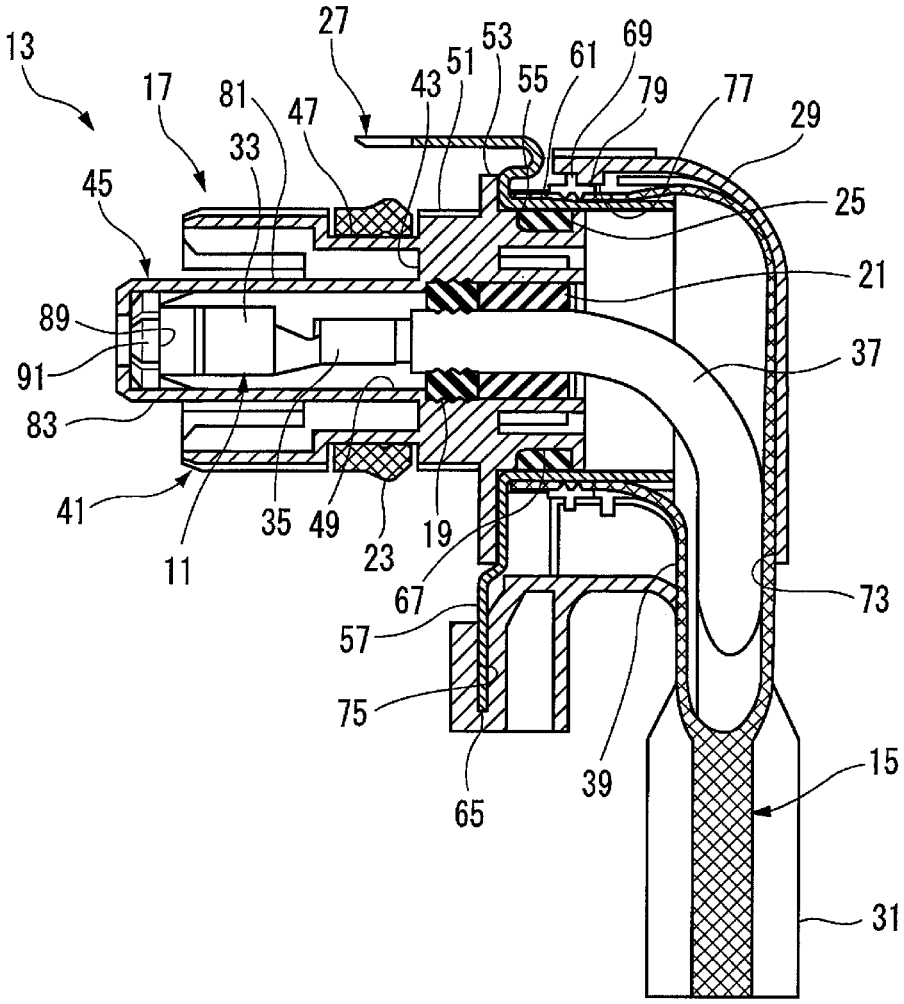
FIG. 2 is a vertical sectional view of the high-voltage female connector shown in FIG. 1.
Figure 3:
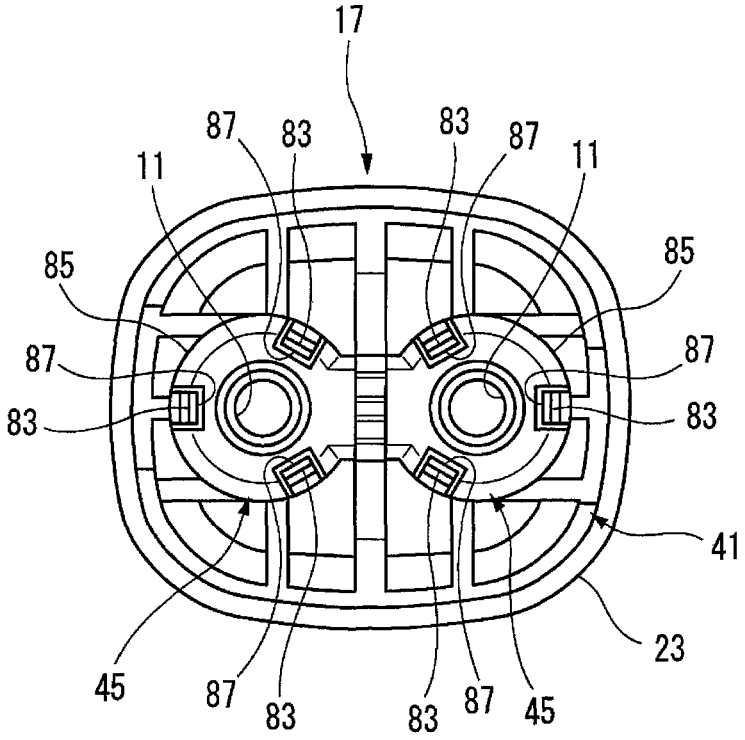
FIG. 3 is a front view of the high-voltage female connector shown in FIG. 1.

As shown in FIGS. 1 to 3, a retaining structure for a terminal fitting 11 according to an embodiment of the invention is preferably applied to a high-voltage female connector 13 which is connected to an inverter of an electric vehicle or a hybrid vehicle, for example. Further, this high-voltage female connector 13 can preferably be used as a terminal table provided in an interior of the inverter.

The high-voltage female connector 13 of this embodiment is assembled by using mainly such members as a terminal fitting 11, a shielded electric wire 15, a housing 17, a rubber plug 19, a rear holder 21, a unit packing 23, a shell packing 25, a shield shell 27, a protector 29, and a rubber boot 31.

As shown in FIG. 2, the terminal fitting 11 is made of conductive metal and has a cylindrical electric contact portion 33 at a front end side and an electric wire connecting portion 35 at a rear end side thereof. A core wire which is exposed at an end portion of the shielded electric wire 15 is crimped and electrically connected to the electric wire connecting portion 35.

The shielded electric wire 15 is a two-core shielded electric wire having a pair of core wires which are each coated with an insulating member 37. The shielded electric wire 15 includes a conductive braid 39 which covers the core wires which are coated individually by the insulating members 37 and an insulating sheath (not shown) which covers the braid 39. The core wires of the shielded electric wire 15 are clamped individually to the electric wire connecting portion 35 for electric connection with the terminal fitting 11. The braid 39 is electrically connected to the shield shell 27. A rod-shaped electric contact portion, not shown, of a mating connector is fitted in the electric contact portion 33. The electric contact portion 33 is electrically connected to the rod-shaped electric contact portion when the rod-shaped contact portion is fitted inside the electric contact portion 33.

The housing 17 is made from an insulating synthetic resin, and an inner cylindrical portion (a cylindrical portion) 45 is formed integrally with the housing 17. The inner cylindrical portion 45 is formed radially inwards of a bottomed outer cylindrical portion 41 so as to extend through a bottom wall portion 43 of the outer cylindrical portion 41 in an axial direction thereof which is identical to an axial direction of the outer cylindrical portion 41. A unit packing installation groove 47 is formed on an outer circumferential surface of the outer cylindrical portion 41, and a ring-shaped unit packing 23 is installed in the unit packing installation groove 47. The unit packing 23 watertightly seals the boundary between the outer cylindrical portion 41 and a housing of a mating connector.

In this embodiment, as shown in FIG. 3, the outer cylindrical portion 41 has an elliptic cross section, and two inner cylindrical portions 45 are provided in parallel in the direction of a major axis of the elliptic cross section. An interior of each inner cylindrical portion 45 constitutes a terminal accommodating chamber 49. Each inner cylindrical portion 45 accommodates one terminal fitting 11 and an end portion of the shielded electric wire 15 which is connected to the terminal fitting 11. The rubber plug 19 is installed on the end portion of the shielded electric wire 15, and the rubber plug 19 watertightly seals the boundary between the shielded electric wire 15 and the terminal accommodating chamber 49. The rear holder 21 is installed at a rear end side of the terminal accommodating chamber 49, and the rear holder 21 locks the housing 17 so as to restrict the withdrawal of the rubber plug 19.

The bottom wall portion 43 is provided in a housing main body portion 51, and a rectangular flange portion 53 is formed on an outer circumference of the housing main body portion 51 in such a way as to project therefrom. An outer circumferential surface of the housing main body portion 51 which is situated at the rear of the flange portion 53 constitutes a shell mounting portion 55.

The shield shell 27 is made of a conductive metallic plate and has a rectangular mounting plate portion 57 which is larger than the flange portion 53 and a fixing plate portion 59 which is formed by bending an upper edge of the mounting plate portion 57 at a right angle. A housing fitting cylindrical portion 61 is formed in the mounting plate portion 57 by bending the mounting plate portion 57 so as to fit on the shell mounting portion 55. A pair of fixing holes 63 are opened in the fixing plate portion 59. The fixing holes 63 constitute insertion holes through which fastening members are inserted to be used to fix the high-voltage female connector 13 to an inverter. An engaging plate portion 65 is formed on a lower edge of the mounting plate portion 57 for engagement with the protector 29.

A shell packing installation groove 67 is formed on an outer circumference of the shell mounting portion 55 of the housing main body portion 51, and the ring-shaped shell packing 25 is installed in the shell packing installation groove 67. In the shield shell 27 in which the housing fitting cylindrical portion 61 is fitted on the shell mounting portion 55, the boundary between the shell mounting portion 55 and the housing fitting cylindrical portion 61 is watertightly sealed by the shell packing 25. In the shield shell 27 which is fitted on the shell mounting portion 55, the housing fitting cylindrical portion 61 is fastened to be fixed to the shell mounting portion 55 by a ring-shaped fixing member 69 which is provided on an outer circumference of the housing fitting cylindrical portion 61. As this occurs, the braid 39 of the shielded electric wire 15 is sandwiched between the ring-shaped fixing member 69 and the housing fitting cylindrical portion 61, whereby the shield shell 27 and the braid 39 are fixed to each other in a conductive state.

Figure 4A:
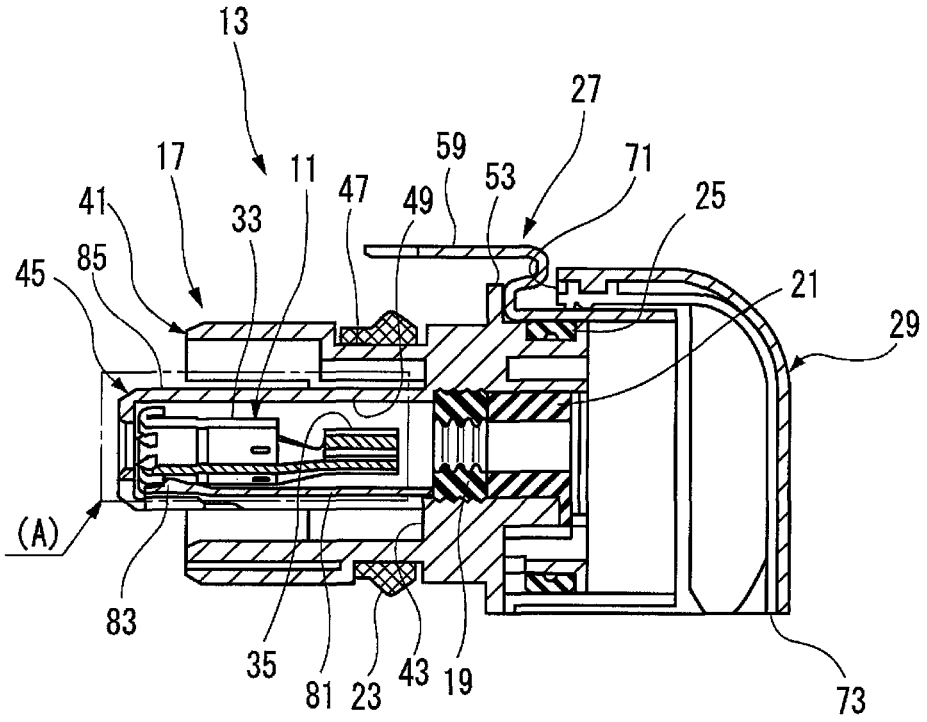
FIG. 4A is a partially cutaway sectional view of a terminal fitting shown in FIG. 2.

The protector 29 is made from an insulating synthetic resin. The protector 29 has a shell fixing opening portion 71 (refer to FIG. 4A) where the protector 29 is fixed to the shield shell 27 and an electric wire outlet opening portion 73 which is opened in a direction orthogonal to an opening axis of the shell fixing opening portion 71. The protector 29 is attached to the shield shell 27 by bringing a lower engaging groove 75 (refer to FIG. 2) into engagement with the engaging plate portion 65 of the shield shell 27 and bringing an upper engaging projecting portion 77 on the shell fixing opening portion 71 into engagement with a recessed groove 79 in the ring-shaped fixing member 69. The shielded electric wire 15 which is drew out of the terminal accommodating chamber 49 is orthogonally bent and is then drew out of the electric wire outlet opening portion 73 as a result of the protector 29 being attached to the shield shell 27. The rubber boot 31 is installed in the electric wire outlet opening portion 73, and the shielded electric wire 15 passes through an interior of the rubber boot 31 which then restricts the shielded electric wire 15 being bent excessively.

Figure 4B:
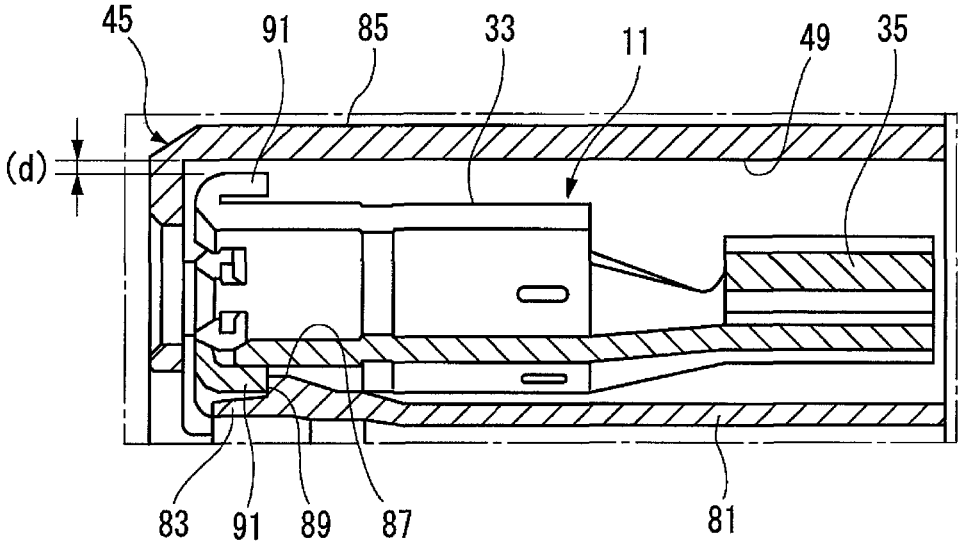
FIG. 4B is an enlarged view of a portion (A) in FIG. 4A.
Figure 5:
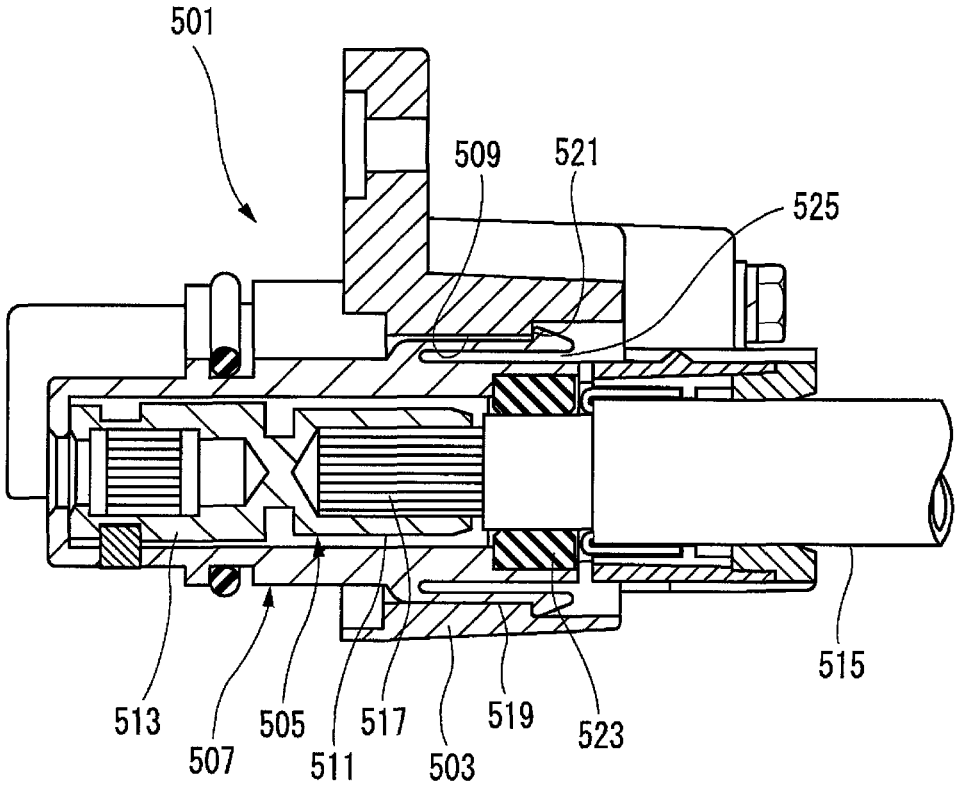
FIG. 5 is a vertical sectional view of a shielded connector including a related-art retaining structure for a terminal fitting.

Incidentally, a moving gap (d) (refer to FIG. 4B) is provided in the terminal accommodating chamber 49 of the inner cylindrical portion 45 so as to allow the electric contact portion 33 of the terminal fitting 11 to move in a radial direction. Namely, an inner diameter of the terminal accommodating chamber 49 is made larger twice the moving gap (d) than an outer diameter of the electric contact portion 33.

As shown in FIGS. 3 and 4, three locking lances 83 are formed in a cylindrical wall portion 81 of the inner cylindrical portion 45. The locking lances 83 lock the terminal fitting 11 which is inserted into the terminal accommodating chamber 49 and hold the terminal fitting 11 in such a way as to allow the terminal fitting 11 to move in the radial direction while restricting the terminal fitting 11 from being dislocated to the rear. Additionally, the locking lances 83 are formed so as not to project from an outer circumferential surface 85 of the cylindrical wall portion 81. In the locking lances 83, a leading end side is made to constitute a free end by a pair of cuts which are made in a direction which follows the axis of the inner cylindrical portion 45 and a cut which connects the pair of cuts at the leading end side, and a lance locking pawl 87 is formed on a radially inner side of the free end.

The lance locking pawl 87 of the locking lance 83 locks the terminal fitting 11 at a lance locking portion 89 which is provided on the electric contact portion 33 of the terminal fitting 11. This lance locking portion 89 is formed by folding back outwardly an electric contact portion leading end 91 so as to be laid on to an outer circumferential surface of the electric contact portion 33.

In this embodiment, the three locking lances 83 are provided along a circumferential direction of the inner cylindrical portion 45. Two or more locking lances 83 can be provided at equal intervals along the circumferential direction of the inner cylindrical portion 45. Since the three locking lances 83 are provided at equal intervals in this embodiment, the locking lances 83 are provided at intervals of 120°. An axis of the electric contact portion 33 can easily be aligned with the axis of the inner cylindrical portion 45 by providing the locking lances 83 at equal intervals along the circumferential direction. However, the locking lances 83 may not be disposed at equal intervals along the circumferential direction. For example, in the event that the locking lances 83 are displaced from upper and lower circumferential positions so as to be disposed near both side portions of the inner cylindrical portion 45, a reduction in height of the inner cylindrical portion 45 in a vertical direction can easily be realized.

Next, the function of the retaining structure for the terminal fitting 11 which is configured in the way described heretofore will be described.

According to the high-voltage female connector 13 which includes the retaining structure for the terminal fitting 11 according to the embodiment, when the terminal fitting 11 is inserted into the terminal accommodating chamber 49 from the leading end side thereof, the three locking lances 83 come to contact slidably the electric contact portion 33 of the terminal fitting 11, whereby the locking lances 83 are elastically deformed radially outwards. When the terminal fitting 11 is inserted to a predetermined position, the lance locking pawls 87 coincide with the lance locking portions 89 of the terminal fitting 11, whereupon the locking lances 83 are elastically restored whereby the lance locking pawls 87 lock the terminal fitting 11 at the lance locking portion 89, which restricts the rearward withdrawal of the terminal fitting 11.

In the terminal fitting 11 of this embodiment, laying the outwardly folded back electric contact portion leading end 91 on the outer circumferential surface of the electric contact portion 33 makes the portion where the outwardly folded back electric portion leading end is so laid constitute a large diameter portion which is larger in diameter by a thickness of the electric contact portion 33 than the outer circumferential surface of the electric contact portion 33, thereby producing a difference in level between the large diameter portion and the outer circumferential surface of the electric contact portion 33. By configuring a step portion which is produced by the difference in level as the lance locking portion 89, it is possible to form the strong and rigid lance locking portion 89. When the terminal fitting 11 is inserted to the predetermined position in the terminal accommodating chamber 49, the terminal fitting 11 is locked at the lance locking portion 89 from a rear end side thereof by the lance locking claws 87 of the locking lances 83, whereby the rearward withdrawal of the terminal fitting 11 is prevented.

In the retaining structure for the terminal fitting 11 of this embodiment, when the terminal fitting 11 is inserted into the terminal accommodating chamber 49, the three locking lances 83 which are provided along the circumferential direction of the inner cylindrical portion 45 come into slidable contact with the outer circumferential surface of the electric contact portion 33, whereby the terminal fitting 11 can easily be positioned at the center of the inner cylindrical portion 45. In the case of an inner cylindrical portion 45 having a limited circumferential length, the number of locking lances 83 should preferably be three at the least in order to ensure the strength of the inner cylindrical portion 45 and the strength of the locking lances 83.

Then, when the mating connector is connected, when the rod-shaped electric contact portion of the mating connector is misaligned with the electric contact portion 33 of the terminal fitting 11, the terminal fitting 11 is moved (aligned) to a position where the center of the electric contact portion 33 is aligned with the center of the rod-shaped electric contact portion as a result of the three locking lances 83 being elastically deformed. Namely, the misalignment of the electric contact portion 33 of the terminal fitting 11 with respect to the rod-shaped electric contact portion is corrected to suppress the frictional force between the terminal fittings, to thereby facilitate the connection of the high-voltage female connector 13 with the mating connector. This movement of the fitting terminal 11 is allowed within the moving gap (d) between the terminal fitting 11 and the terminal accommodating chamber 49. In addition, even in the event that the moving gap (d) becomes nil (that is, even in the event that the terminal fitting 11 comes into contact with an inner wall of the terminal accommodating chamber 49), since the locking lances 83 are formed so as not to project from the outer circumferential surface 85 of the cylindrical wall portion 81, there will be caused no problem in connection of the inner cylindrical portion 45 with a housing of the mating connector.

In this way, according to the configuration of the high-voltage female connector 13 which includes the retaining structure for the terminal fitting 11 according to the embodiment, the necessity of an exclusive space where to dispose the locking lances 83 only is obviated by providing the locking lances 83 directly on the cylindrical wall portion 81 which defines the terminal accommodating chamber 49. In addition, although the water proofing construction has to be secured between the shielded electric wire 15 and the inner housing inwards of (in alignment in a radial direction with) the portion where the locking lances 83 and the terminal accommodating chamber 49 are formed in the related-art retaining structure, no such water proofing construction is necessary, and only the simple rubber plug (packing) 19 is enough to be provided on an inner circumference of the cylindrical wall portion 81, which simplifies the water proofing construction.

In the retaining structure for the terminal fitting 11 described above, in the event that the terminal fitting 11 is inserted halfway into the terminal accommodating chamber 49, thereby producing a non-retained state (that is, a half-fitted state) in which the terminal fitting 11 is not completely locked by the locking lances 83, the locking lances 83 are allowed to project from the outer circumferential surface 85 of the cylindrical wall portion 81. In the event that the locking lances 83 are configured so as to project from the outer circumferential surface 85 only when such a half-fitted state occurs, the locking lances 83 which project from the outer circumferential surface 85 come into interference with the housing of the mating connector when the terminal fitting 11 is fitted halfway, allowing the half-fitted state of the terminal fitting 11 to be detected.

Consequently, according to the high-voltage female connector 13 which includes the retaining structure for the terminal fitting 11 according to the embodiment, the misalignment in connecting terminals can be corrected, and the high-voltage female connector 13 can be made simple in construction and small in size.

Here, the characteristics of the retaining structure for a terminal fitting according to the embodiments will be itemized under [1] to [3] below in a summarized fashion.

[1] The retaining structure for a terminal fitting (11), the structure including the terminal fitting (11) which has the cylindrical electric contact portion (33) at the front end side and the electric wire connecting portion (35) at the rear end side thereof, the housing (17) with which the cylindrical portion (the inner cylindrical portion 45) is integrally formed, the terminal accommodating chamber (49) which is provided inwards of the cylindrical portion (the inner cylindrical portion 45) and which accommodates the terminal fitting (11) with the moving gap (d) left which enables the radial movement of the electric contact portion (33), and the plurality of locking lances (83) which are formed on the cylindrical wall portion (81) of the cylindrical portion (the inner cylindrical portion 45) so as not to project from the outer circumferential surface (85) thereof and which lock the lance locking portion (89) on the terminal fitting (11) which is inserted into the terminal accommodating chamber (49) so as to retain the terminal fitting (11) in such a way as to enable a radial movement thereof while restricting the rearward withdrawal of the terminal fitting (11).

[2] In the retaining structure for a terminal fitting (11) according to [1] above, the plurality of locking lances (83) of three or more are provided along a circumferential direction of the cylindrical portion (the inner cylindrical portion 45).

[3] In the retaining structure for a terminal fitting (11) according to [1] or [2] above, the lance locking portion (89) which is locked by the locking lances (83) is formed on the electric contact portion (33) by folding back the electric contact portion leading end (91) so as to be laid on to the outer circumferential surface of the electric contact portion.

The invention is not limited to the embodiment that has been described heretofore and hence can be modified or improved as required. In addition, the materials, shapes, dimensions, numbers and locations of the constituent elements of the embodiment are not limited to those described in the embodiment and hence can be determined arbitrarily as long as the invention can be achieved.

For example, in the embodiment, the inner cylindrical portion 45 is described as the cylindrical portion which is formed integrally with the housing 17 so as to lie radially inwards of the bottomed outer cylindrical portion 41 while extending through the bottom wall portion 43 of the outer cylindrical portion 41 in the axial direction thereof which is identical to the axial direction of the outer cylindrical portion 41. However, the invention is not limited thereto. Only the cylindrical portion can be formed integrally with the housing with the unit packing 23 installed at a proximal portion side of the cylindrical portion.

According to the retaining structure for a terminal fitting according to the embodiments, it is possible to provide the retaining structure for a fitting which can correct the misalignment in connecting terminals and which is simple in construction and small in size.

What is claimed is:

1. A retaining structure for a terminal fitting, the structure comprising:

a terminal fitting which has a electric contact portion at a front end side and an electric wire connecting portion at a rear end side thereof, the electric contact portion has a cylindrical outer surface; and a housing with which a cylindrical portion is integrally formed, wherein the cylindrical portion includes a cylindrical wall that defines a terminal accommodating chamber which is provided inwards of the cylindrical portion and which accommodates the terminal fitting with a moving gap left which enables a radial movement of the electric contact portion; and wherein a plurality of locking lances are formed on a cylindrical wall portion of the cylindrical portion so as not to project from an outer circumferential surface thereof, the plurality of locking lances normally hold the electric contact portion such that an entire cylindrical outer surface of the electric contact portion is spaced apart from the cylindrical wall by the moving gap, and the plurality of locking lances lock a lance locking portion of the terminal fitting which is inserted into the terminal accommodating chamber so as to retain the terminal fitting in such a way as to enable a radial movement of the terminal fitting while restricting a rearward withdrawal of the terminal fitting.

2. The retaining structure for a terminal fitting according to claim 1, wherein the plurality of locking lances of three or more are provided along a circumferential direction of the cylindrical portion.

3. The retaining structure for a terminal fitting according to claim 1, wherein the lance locking portion which is locked by the locking lances is formed on the electric contact portion by folding back an electric contact portion leading end so as to be laid on to an outer circumferential surface of the electric contact portion.

4. The retaining structure for a terminal fitting according to claim 1, wherein leading end sides of the plurality of locking lances are respectively free ends.

* * * * *